US006056475A

United States Patent [19]

Peterick et al.

[11] Patent Number: 6,056,475

[45] Date of Patent: May 2, 2000

[54] SKI ASSEMBLY FOR A SCREED

[76] Inventors: Ron Peterick, 8000 Acorn Rd., Royalton, Minn. 56373; Rick Mehrwerth, 5075 Remora Rd., Sauk Rapids, Minn. 56379

[21] Appl. No.: 09/061,066

[22] Filed: Apr. 16, 1998

[51] Int. Cl.[7] ..... E01C 19/22

[52] U.S. Cl. ..... 404/119; 404/118

[58] Field of Search ..... 404/96, 97, 102, 404/114, 119, 118

[56] References Cited

U.S. PATENT DOCUMENTS

| | | | |
|---|---|---|---|
| 1,773,431 | 8/1930 | Mosel | 404/119 |
| 2,138,828 | 12/1938 | Barber | 404/114 |
| 2,168,507 | 8/1939 | Barber | 404/114 |
| 2,351,593 | 6/1944 | Barber | 404/96 |
| 2,725,799 | 12/1955 | Day et al. | 404/102 |
| 2,948,202 | 8/1960 | Millikin | 404/119 |
| 3,095,789 | 7/1963 | Melvin et al. | 404/114 |
| 3,359,875 | 12/1967 | Reider | 404/102 |
| 4,289,421 | 9/1981 | Sampey et al. | 404/119 |
| 4,408,978 | 10/1983 | Owens | 404/114 |
| 4,496,265 | 1/1985 | Fragale | 404/96 |
| 4,702,642 | 10/1987 | Musil | 404/96 |
| 5,201,603 | 4/1993 | Bassett et al. | 404/96 |
| 5,203,642 | 4/1993 | Heller et al. | 404/118 |
| 5,328,295 | 7/1994 | Allen | 404/84.1 |
| 5,332,331 | 7/1994 | Critz et al. | 404/96 |
| 5,405,214 | 4/1995 | Campbell | 404/80 |
| 5,484,229 | 1/1996 | Reece | 404/118 |

*Primary Examiner*—Thomas B. Will
*Assistant Examiner*—Kristine M Markovich

[57] ABSTRACT

A power screed sled apparatus is provided including a power screed including an elongated frame with a pair of ends. Also included is a pair of skis each coupled to an associated end of the frame of the power screed for transporting the same.

9 Claims, 3 Drawing Sheets

SKI ASSEMBLY FOR A SCREED

BACKGROUND OF THE INVENTION

1. Field of the Invention

The present invention relates to screeds and more particularly pertains to a new ski assembly for a screed to be used to conveniently transport and elevate a power screed.

2. Description of the Prior Art

The use of screeds is known in the prior art. More specifically, screeds heretofore devised and utilized are known to consist basically of familiar, expected and obvious structural configurations, notwithstanding the myriad of designs encompassed by the crowded prior art which have been developed for the fulfillment of countless objectives and requirements.

Known prior art screeds include U.S. Pat. Nos. 5,257,764; 5,154,536; 5,224,793; 5,281,050; 5,324,085; and U.S. Pat. No. Des. 306,963.

In these respects, the ski assembly for a screed according to the present invention substantially departs from the conventional concepts and designs of the prior art, and in so doing provides an apparatus primarily developed for the purpose of conveniently transporting and elevating a power screed.

SUMMARY OF THE INVENTION

In view of the foregoing disadvantages inherent in the known types of screeds now present in the prior art, the present invention provides a new ski assembly for a screed construction wherein the same can be utilized for conveniently transporting and elevating a power screed.

The general purpose of the present invention, which will be described subsequently in greater detail, is to provide a new ski assembly for a screed apparatus and method which has many of the advantages of the screeds mentioned heretofore and many novel features that result in a new ski assembly for a screed which is not anticipated, rendered obvious, suggested, or even implied by any of the prior art screeds, either alone or in any combination thereof.

To attain this, the present invention generally comprises a power screed with an elongated frame having a pair of ends. A pair of skis each include a planar plate with a periphery defined by a horizontally oriented linear top edge and a horizontally oriented linear bottom edge with a length equal to that of the top edge. Such periphery is further defined by a front edge with a vertically oriented linear upper portion and a linear lower portion extending downwardly and rearwardly from the upper portion. Associated therewith is a rear edge including a linear upper portion extending downwardly and rearwardly from the top edge and a vertically oriented linear lower portion. As shown in the Figures, each of the skis further includes a planar rectangular lip integrally coupled to the bottom edge. Such lip extends outwardly from the ski in perpendicular relationship therewith. For carrying purposes, a first oval cut out is formed in each ski adjacent to the top edge and the upper portion of the front edge. The first oval cut out is preferably situated in parallel relationship with the top edge. Also included is a second oval cut out formed therein adjacent to the upper portion of the rear edge and in parallel relationship therewith. Next provided is a pair of elevation assemblies each including a vertically oriented cylinder mounted to a side of the corresponding ski. The cylinder has a threaded interior for reasons that will soon become apparent. Each elevation assembly further has a cylindrical tube slidably situated over the cylinder. Rotatably coupled within the tube is a threaded post that is engaged with the threaded interior of the cylinder. As such, the threaded post is adapted for raising the tube upon the rotation of the threaded post. Each elevation assembly further includes an S-shaped crank unit mounted to a top of the tube and engaged with a top end of the threaded post. This is preferably accomplished by way of a pair of bevel gears, as shown in FIG. 2. In use, the crank unit may be used for selectively rotating the threaded post. Finally, a mounting assembly includes a pair of guide bolts mounted on the associated ski so as to flank the associated cylinder. A pair of parallel vertical slider bars each have a bottom with a vertical slot formed therein for slidably receiving an associated one of the guide bolts. The mounting assembly further has a planar adapter plate coupled between top ends of the vertical slider bars and a central extent of the tube of the elevation assembly. In use, the adapter plates of the mounting assemblies may be secured to the ends of the power screed for elevating the same by way of the elevation assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new ski assembly for a screed apparatus and method which has many of the advantages of the screeds mentioned heretofore and many novel features that result in a new ski assembly for a screed which is not anticipated, rendered obvious, suggested, or even implied by any of the prior art screeds, either alone or in any combination thereof.

It is another object of the present invention to provide a new ski assembly for a screed which may be easily and efficiently manufactured and marketed.

It is a further object of the present invention to provide a new ski assembly for a screed which is of a durable and reliable construction.

An even further object of the present invention is to provide a new ski assembly for a screed which is susceptible of a low cost of manufacture with regard to both materials and labor, and which accordingly is then susceptible of low prices of sale to the consuming public, thereby making such ski assembly for a screed economically available to the buying public.

Still yet another object of the present invention is to provide a new ski assembly for a screed which provides in the apparatuses and methods of the prior art some of the advantages thereof, while simultaneously overcoming some of the disadvantages normally associated therewith.

Still another object of the present invention is to provide a new ski assembly for conveniently transporting and elevating a power screed.

Even still another object of the present invention is to provide a new ski assembly for a screed that includes a pair of skis each coupled to an associated end of the screed for transporting the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
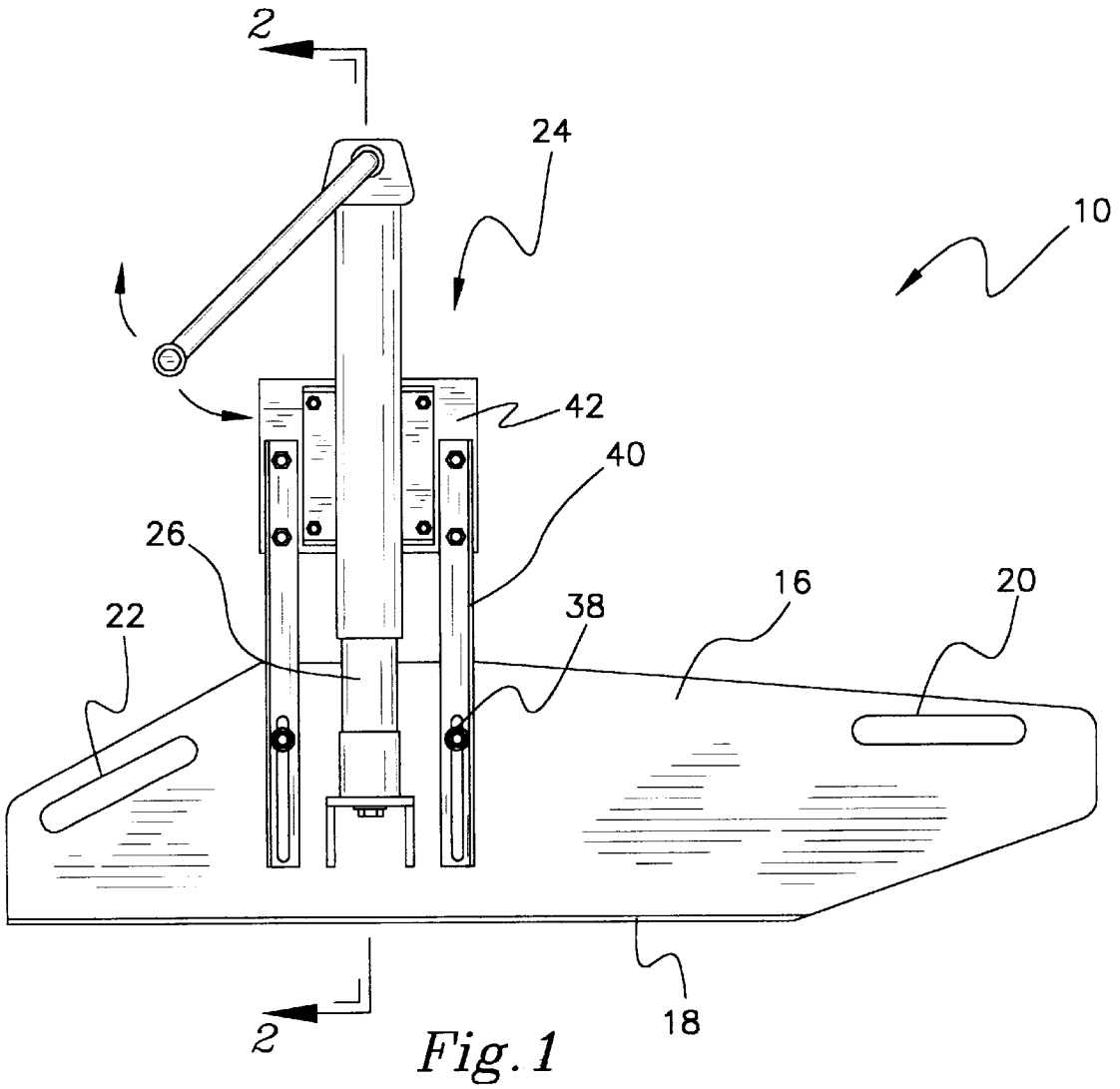
FIG. 1 is a side view of a new ski assembly for a screed according to the present invention.

With reference now to the drawings, and in particular to FIGS. 1 through 4 thereof, a new ski assembly for a screed embodying the principles and concepts of the present invention and generally designated by the reference numeral 10 will be described.

The present invention, designated as numeral 10, includes a power screed 12 with an elongated frame 14 having a pair of ends. A pair of skis 16 each include a planar plate with a periphery defined by a horizontally oriented linear top edge and a horizontally oriented linear bottom edge with a length equal to that of the top edge. Such periphery is further defined by a front edge with a vertically oriented linear upper portion and a linear lower portion extending downwardly and rearwardly from the upper portion. Associated therewith is a rear edge including a linear upper portion extending downwardly and rearwardly from the top edge and a vertically oriented linear lower portion.

As shown in the Figures, each of the skis further includes a planar rectangular lip 18 integrally coupled to the bottom edge. Such lip extends outwardly from the ski in perpendicular relationship therewith. Ideally, the lip has a width equal to less than ⅛ a height of the associated ski. For carrying purposes, a first oval cut out 20 is formed in each ski adjacent to the top edge and the upper portion of the front edge. The first oval cut out is preferably situated in parallel relationship with the top edge. Also included is a second oval cut out 22 formed in the ski adjacent to the upper portion of the rear edge and in parallel relationship therewith.

Figure 2:
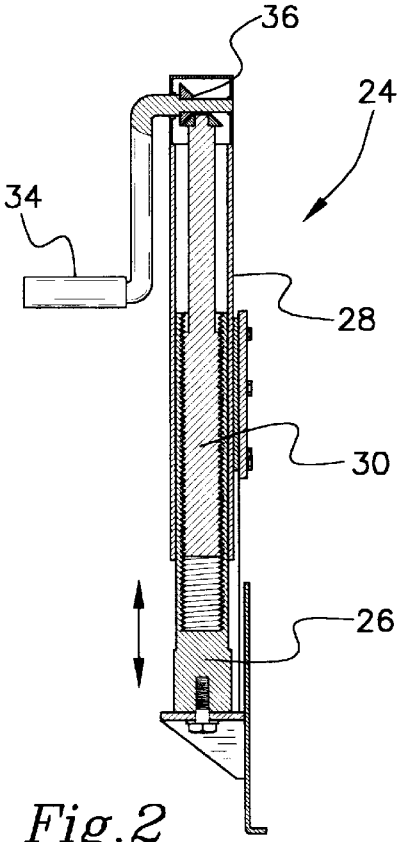
FIG. 2 is a side cross-sectional view of one of the elevation assemblies of the present invention.
Figure 3:
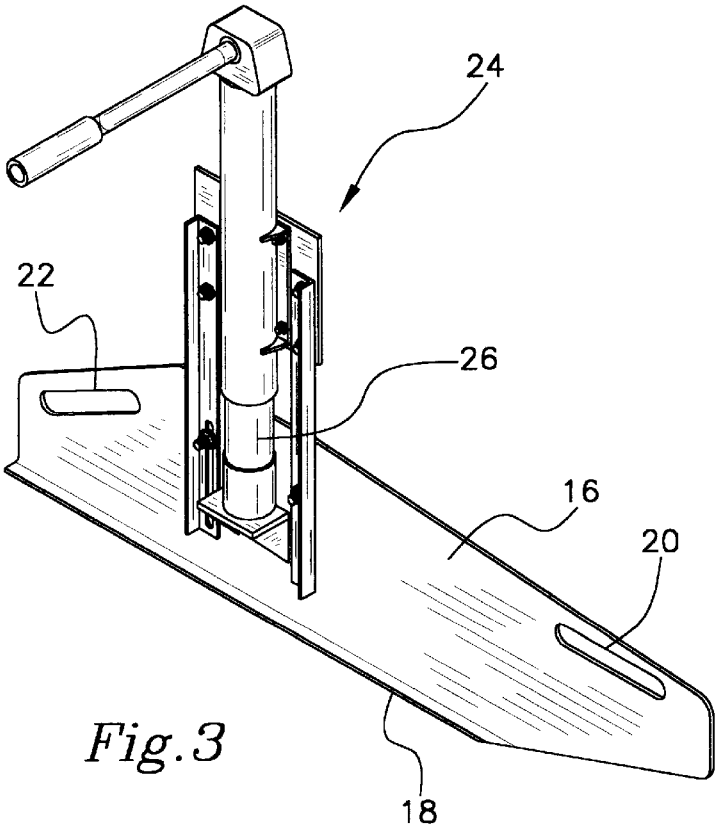
FIG. 3 is a perspective view of one of the skis, elevation assemblies and mounting assemblies of the present invention.
Figure 4:
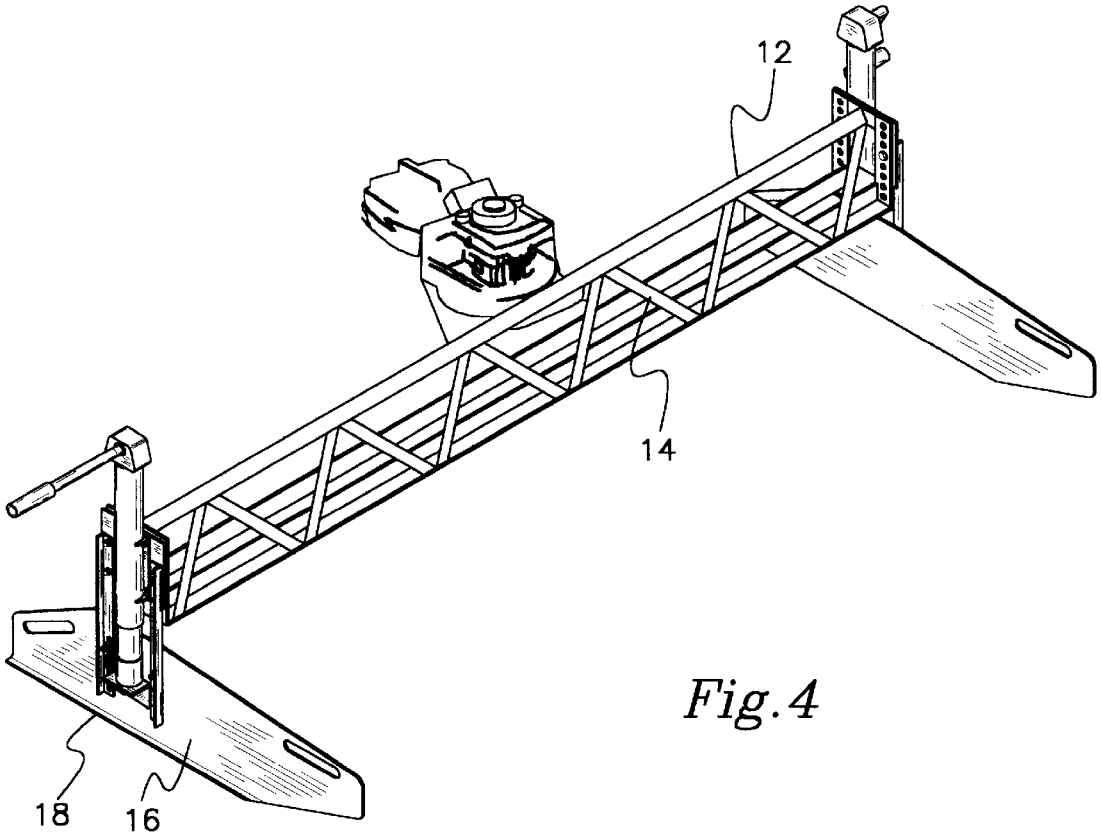
FIG. 4 is a perspective view of the present invention in use.

Next provided is a pair of elevation assemblies 24 each including a vertically oriented cylinder 26 mounted to a side of the corresponding ski. The cylinder has a threaded interior for reasons that will soon become apparent. The cylinder is preferably mounted on a supported ledge which is secured to the ski. Further, the mounting of the cylinder is ideally effected adjacent to the rear edge of the ski. Each elevation assembly further has a cylindrical tube 28 slidably situated over the cylinder. Rotatably coupled within the tube is a threaded post 30 that is engaged with the threaded interior of the cylinder. As such, the threaded post is adapted for raising the tube upon being rotated. As shown in FIG. 2, the cylinder and tube preferably have equal lengths.

Each elevation assembly further includes an S-shaped crank unit 34 mounted to a top of the tube and engaged with a top end of the threaded post. This is preferably accomplished by way of a pair of bevel gears 36, as shown in FIG. 2. In use, the crank unit may be used for selectively rotating the threaded post. In an alternate embodiment, the crank unit, threaded post and cylinder may be replaced with a hydraulic cylinder.

Finally, a mounting assembly includes a pair of guide bolts 38 mounted on the associated ski so as to flank the associated cylinder. A pair of parallel vertical slider bars 40 each have a bottom with a vertical slot formed therein for slidably receiving an associated one of the guide bolts. The mounting assembly further has a planar adapter plate 42 coupled between top ends of the vertical slider bars and a central extent of the tube of the elevation assembly. In use, the adapter plates of the mounting assemblies may be secured to the ends of the power screed for elevating the same by way of the elevation assembly. The present invention thus affords a unique means of both transporting and elevating a power screed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A power screed sled apparatus comprising, in combination:

a power screed including an elongated frame with a pair of ends;

a pair of skis each including a planar plate with a periphery defined by a horizontally oriented linear top edge, a front edge with a vertically oriented linear upper portion and a linear lower portion extending downwardly and rearwardly from the upper portion, a rear edge including a linear upper portion extending downwardly and rearwardly from the top edge and a vertically oriented linear lower portion, and a horizontally oriented linear bottom edge with a length equal to that of the top edge, each of the skis further including a planar rectangular lip integrally coupled to the bottom edge and extending outwardly therefrom in perpendicular relationship therewith, a first oval cut out formed therein adjacent to the top edge and the upper portion of the front edge wherein the first oval cut out is situated in parallel relationship with the top edge, and a second oval cut out formed therein adjacent to the upper portion of the rear edge and in parallel relationship therewith;

a pair of elevation assemblies each including a vertically oriented cylinder mounted to a side of the corresponding ski from which the lip extends, the cylinder having a threaded interior, each elevation assembly further including a cylindrical tube slidably situated over the cylinder, a threaded post rotatably coupled within the tube and engaged with the threaded interior of the cylinder for raising the tube upon the rotation of the threaded post, an S-shaped crank assembly rotatably mounted to a top of the tube and engaged with a top end of the threaded post by way of a pair of bevel gears for selectively rotating the threaded post; and a mounting assembly including a pair of guide bolts mounted on the associated ski so as to flank the associated cylinder, a pair of parallel vertical slider bars each having a bottom with a vertical slot formed therein for slidably receiving an associated one of the guide bolts, and a planar adapter plate coupled between top ends of the vertical slider bars and a central extent of the tube of the elevation assembly, wherein the adapter plates of the mounting assemblies may be secured to the ends of the power screed for elevating the power screed by way of the elevation assembly.

2. A power screed sled apparatus comprising:

a power screed including an elongated frame with a pair of ends;

a pair of skis each coupled to an associated end of the frame of the power screed for transporting the power screed sled apparatus; and a pair of elevation assemblies each including a vertically oriented cylinder mounted to a side of a corresponding one of the pair of skis, each cylinder having a threaded interior, each elevation assembly further including a cylindrical tube slidably situated over the cylinder, a threaded post rotatable coupled within the tube and engaged with the threaded interior of the cylinder for raising the tube upon the rotation of the threaded post, a crank assembly rotatably mounted to a top of the tube and engaged with a top end of the threaded post by way of a pair of bevel gears for selectively rotating the threaded post.

3. The power screed sled apparatus as set forth in claim 2 wherein the skis are plates which reside in vertical planes.

4. The power screed sled apparatus as set forth in claim 3 wherein an outwardly extending lip is formed on a bottom edge of each plate.

5. The power screed sled apparatus as set forth in claim 2 wherein at least one cut out is formed in each ski for carrying purposes.

6. The power screed sled apparatus as set forth in claim 2, further comprising:

a mounting assembly including a pair of guide bolts mounted on the associated ski so as to flank the associated cylinder, a pair of parallel vertical slider bars each having a bottom with a vertical slot formed therein for slidably receiving an associated one of the guide bolts, and a planar adapter plate coupled between top ends of the vertical slider bars and a central extent of the tube of the elevation assembly, wherein the adapter plates of the mounting assemblies may be secured to the ends of the power screed for elevating the power screed by way of the elevation assembly.

7. The power screed sled apparatus as set forth in claim 6 wherein the skis are plates which reside in vertical planes.

8. The power screed sled apparatus as set forth in claim 7 wherein an outwardly extending lip is formed on a bottom edge of each plate.

9. The power screed sled apparatus as set forth in claim 6 wherein at least one cut out is formed in each ski for carrying purposes.

* * * * *